US010436473B2

(12) United States Patent
Kuramori et al.

(10) Patent No.: US 10,436,473 B2
(45) Date of Patent: Oct. 8, 2019

(54) AIR CONDITIONING INDOOR UNIT

(71) Applicant: DAIKIN INDUSTRIES, LTD., Osaka-shi, Osaka (JP)

(72) Inventors: Tetsutomo Kuramori, Kusatsu (JP); Masanori Ikebe, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 28 days.

(21) Appl. No.: 15/547,006

(22) PCT Filed: Jan. 18, 2016

(86) PCT No.: PCT/JP2016/051255
§ 371 (c)(1),
(2) Date: Jul. 27, 2017

(87) PCT Pub. No.: WO2016/121547
PCT Pub. Date: Aug. 4, 2016

(65) Prior Publication Data

US 2017/0370612 A1 Dec. 28, 2017

(30) Foreign Application Priority Data

Jan. 30, 2015 (JP) ..... 2015-016660

(51) Int. Cl.
*F24F 13/20* (2006.01)
*F24F 13/22* (2006.01)
(Continued)

(52) U.S. Cl.
CPC ..... *F24F 13/20* (2013.01); *F24F 1/0011* (2013.01); *F24F 1/027* (2013.01); *F24F 13/22* (2013.01); *F24F 2013/221* (2013.01)

(58) Field of Classification Search
CPC .. F24F 13/20; F24F 13/22; F24F 1/027; F24F 1/0011; F24F 11/02; F24F 13/222; F24F 13/224
See application file for complete search history.

(56) References Cited

U.S. PATENT DOCUMENTS

2015/0300681 A1* 10/2015 Hirakawa ..... F24F 13/22 165/121

FOREIGN PATENT DOCUMENTS

EP 0 962 717 A1 12/1999
JP 2003-232560 A 8/2003
(Continued)

OTHER PUBLICATIONS

International Preliminary Report of corresponding PCT Application No. PCT/JP2016/051255 dated Aug. 10, 2017.
(Continued)

*Primary Examiner* — Cassey D Bauer
(74) *Attorney, Agent, or Firm* — Global IP Counselors, LLP

(57) ABSTRACT

An air conditioning indoor unit includes a body, a panel, and a horizontal flap. The body is provided with an air outlet. The panel is positioned to cover the front of the body. The horizontal flap is able to vary the air direction of conditioned air blown out from the air outlet. A recess recessed toward the back side of the air conditioning indoor unit is disposed between an upper edge of an open peripheral edge of the air outlet and a lower end of the panel. During non-operation, the recess and the air outlet are covered by the horizontal flap.

11 Claims, 8 Drawing Sheets

(51) Int. Cl.
*F24F 1/027* (2019.01)
*F24F 1/0011* (2019.01)

(56) References Cited

FOREIGN PATENT DOCUMENTS

| | | | |
|---|---|---|---|
| JP | 2011-080639 | A | 4/2011 |
| JP | 2013-148237 | A | 8/2013 |

OTHER PUBLICATIONS

International Search Report of corresponding PCT Application No. PCT/JP2016/051255 dated Apr. 19, 2016.
European Search Report of corresponding EP Application No. 16 74 3151.9 dated Dec. 21, 2017.

* cited by examiner

AIR CONDITIONING INDOOR UNIT

CROSS-REFERENCE TO RELATED APPLICATIONS

This U.S. National stage application claims priority under 35 U.S.C. § 119(a) to Japanese Patent Application No. 2015-016660, filed in Japan on Jan. 30, 2015, the entire contents of which are hereby incorporated herein by reference.

TECHNICAL FIELD

The present invention relates to an air conditioning indoor unit.

BACKGROUND ART

As disclosed in JP-A-2003-232560, known in the art is an air conditioning indoor unit which can change conditioned air blown out from an air outlet into an airflow directed upwardly by using horizontal flaps.

SUMMARY

Technical Problem

If the conditioned air blown out from the air outlet is cold air, when the horizontal flaps upwardly adjust the air direction of the conditioned air, due to a difference in temperature between the outside and the inside of a casing, condensation may occur on a portion constituting the front surface of the casing. As a countermeasure against this, for example, as disclosed in JP-A-2003-232560, a groove in a portion of the front surface of the casing above the air outlet reduces the conditioned air blown out from the air outlet from changing into an airflow along the front surface to reduce occurrence of condensation on the front surface.

However, since the front surface of the casing is a design surface visible to a user, JP-A-2003-232560 presents a problem that the groove in the front surface degrades the design thereof.

An object of the present invention is to provide an air conditioning indoor unit which can reduce the occurrence of condensation on the front surface thereof and can improve the design thereof.

Solution to Problem

An air conditioning indoor unit according to a first aspect of the present invention comprises a body, a panel and a horizontal flap. The body is provided with an air outlet. The panel is positioned in such a way as to cover the front of the body. The horizontal flap is able to vary the air direction of conditioned air blown out from the air outlet. A recess recessed toward the back side of the air conditioning indoor unit is disposed between an upper edge of an open peripheral edge of the air outlet and a lower end of the panel. During non-operation, the recess and the air outlet are covered by the horizontal flap.

In the air conditioning indoor unit according to a first aspect of the present invention, the recess is disposed between the upper edge of the air outlet and the lower end of the panel. Thus, even when the horizontal flap upwardly adjusts the air direction of cold air as conditioned air, the likelihood of occurrence of condensation on the front surface of the panel can be reduced when the cold air enters between a front surface of the body and a back surface of the panel from a joint between the lower end of the panel and the body to create a difference in temperature between the front surface side and the back side of the panel. Moreover, with this air conditioning indoor unit, since the recess and the air outlet are covered by the horizontal flap during the non-operation, the recess is hardly visible to a user during the non-operation. Thus, the design thereof can be improved better than the design of a configuration of a recess visible from the outside during the non-operation.

Thereby, the occurrence of condensation on the front surface of the air conditioning indoor unit can be reduced, and the design thereof can be improved.

An air conditioning indoor unit according to a second aspect of the present invention is the air conditioning indoor unit of the first aspect, in which the recess is disposed above the upper edge in the body. Thus, with this air conditioning indoor unit, even when the horizontal flap upwardly adjusts the air direction of cold air as conditioned air, the airflow along the upper edge of the body can be separated from the body.

Thereby, the likelihood of cold air entering between the back surface of the panel and the front surface of the body from the joint between the lower end of the panel and the body can be reduced.

An air conditioning indoor unit according to a third aspect of the present invention is the first aspect or the second aspect of the air conditioning indoor unit, in which a cross-sectional area of the recess is 10 $mm^2$ or more. The cross-sectional area is perpendicular to a longitudinal direction of the air conditioning indoor unit. With this air conditioning indoor unit, since the cross-sectional area of the recess is 10 $mm^2$ or more, the likelihood of an airflow along the upper edge of the body not being separated from the body can be reduced.

An air conditioning indoor unit according to a fourth aspect of the present invention is the air conditioning indoor unit of any one of the first to third aspects, in which the body includes an inclination surface between an upper edge of a perimeter of the recess and the lower end of the panel. The inclination surface is inclined toward the back side of the air conditioning indoor unit. During the non-operation, the recess, the air outlet, and the inclination surface are covered by the horizontal flap. With this air conditioning indoor unit, since the inclination surface lies between the upper edge of the perimeter of the recess and the lower end of the panel, that is, above the upper edge of the perimeter of the recess, even when the horizontal flap does not cover the recess, the likelihood of the recess being conspicuous can be reduced.

An air conditioning indoor unit according to a fifth aspect of the present invention is the air conditioning indoor unit of any one of the first to fourth aspects that comprises a fan. The fan is positioned in the body. The fan generates a flow of air having been sucked into the body toward the air outlet. The body has a grille and a scroll. The grille includes a front surface. The front panel is positioned in front of the front surface. The scroll extends from the front of the fan to the air outlet. The scroll guides conditioned air to the air outlet. A front end of the scroll more frontwardly projects relative to a portion of the front surface located in the neighborhood of the air outlet. With this air conditioning indoor unit, since the front end of the scroll more frontwardly projects relative to the portion of the front surface located in the neighborhood of the air outlet, even when the horizontal flap upwardly adjusts the air direction of cold air as conditioned air, the likelihood of the cold air, which has been blown out from the air outlet, flowing along the front surface can be reduced.

Advantageous Effects of Invention

With the air conditioning indoor unit according to the first aspect of the present invention, the occurrence of condensation on the front surface thereof can be reduced, and the design thereof can be improved.

With the air conditioning indoor unit according to the second aspect of the present invention, the likelihood of cold air entering between the back surface of the panel and the front surface of the body from the joint between the lower end of the panel and the body can be reduced.

With the air conditioning indoor unit according to the third aspect of the present invention, the likelihood of an airflow along the upper edge of the body not being separated from the body can be reduced.

With the air conditioning indoor unit according to the fourth aspect of the present invention, the likelihood of the recess being conspicuous can be reduced.

With the air conditioning indoor unit according to the fifth aspect of the present invention, the likelihood of the conditioned air, which has been blown out from the air outlet, flowing along the front surface can be reduced.

DESCRIPTION OF EMBODIMENT

Hereinafter, an air conditioning indoor unit 100 according to one embodiment of the present invention will be described with reference to the drawings. The embodiment below is a specific example of the present invention and is not intended to limit the technical scope of the present invention. The embodiment below is also appropriately alterable in a scope that does not depart from the gist of the invention.

(1) Structure of Air Conditioning Indoor Unit 100

Figure 1:
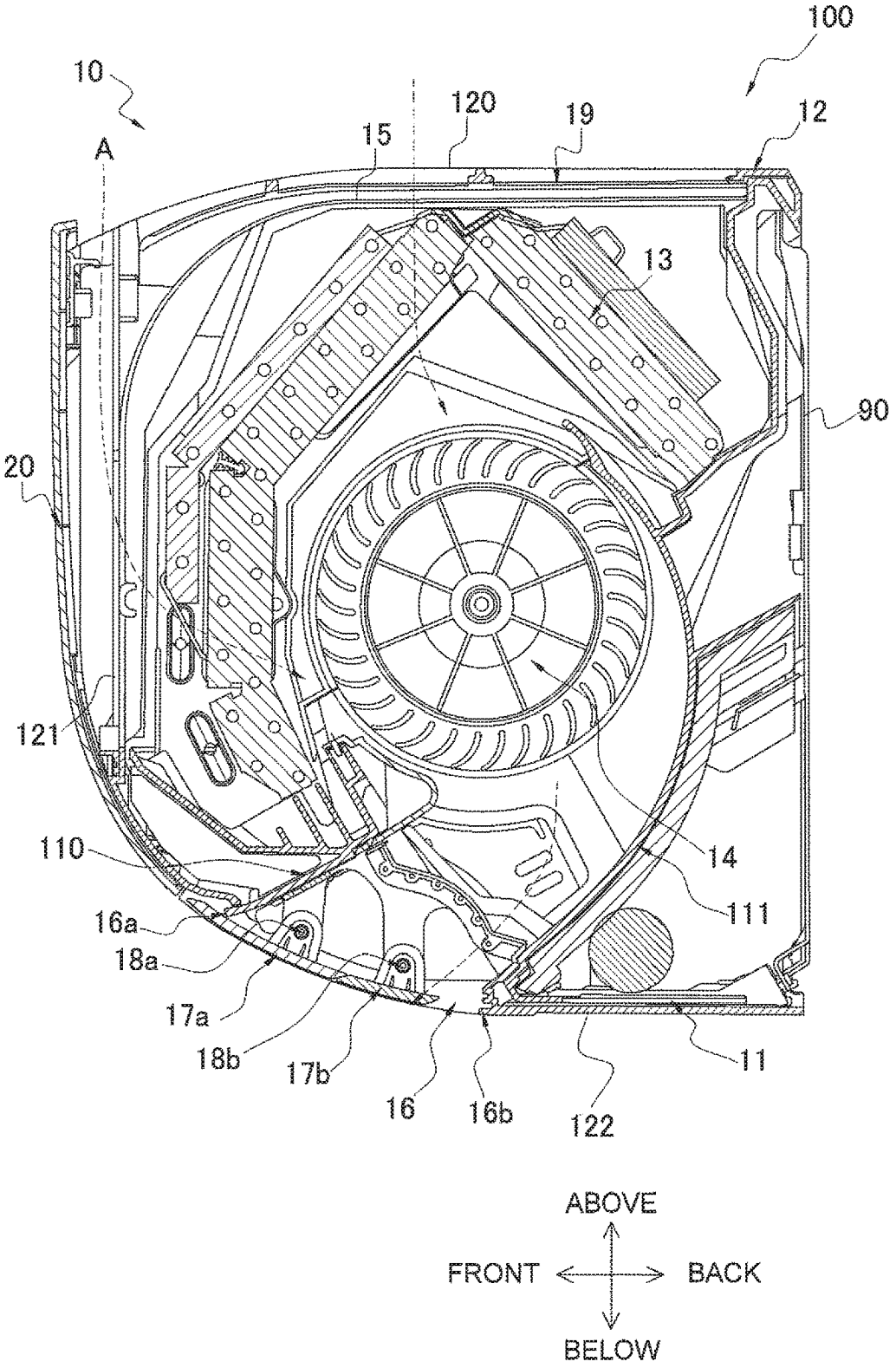
FIG. 1 is a vertical cross sectional view of an air conditioning indoor unit according to one embodiment of the present invention.
Figure 2:
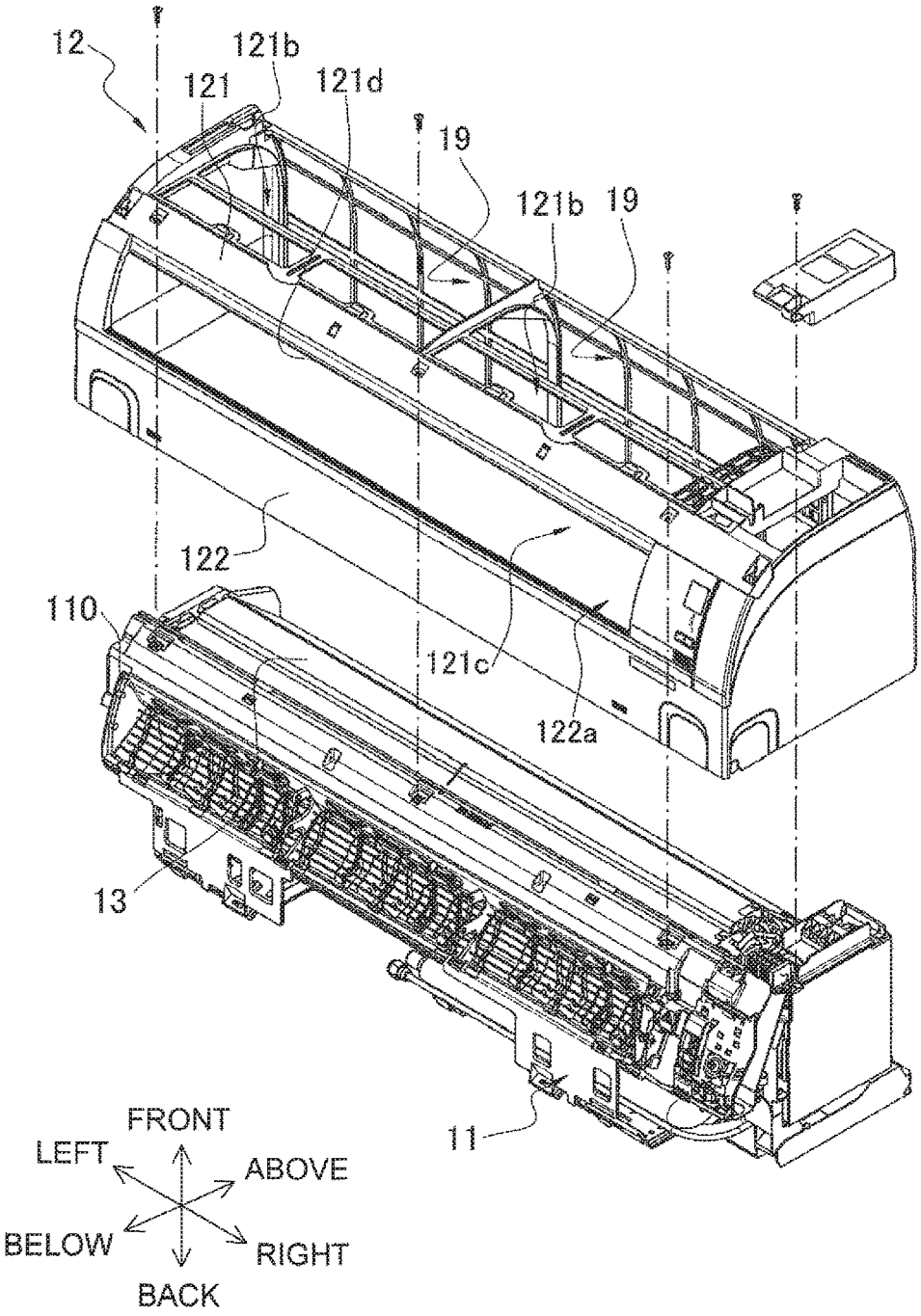
FIG. 2 illustrates an assembly of an indoor heat exchanger and an indoor fan separated from a front grille.
Figure 3:
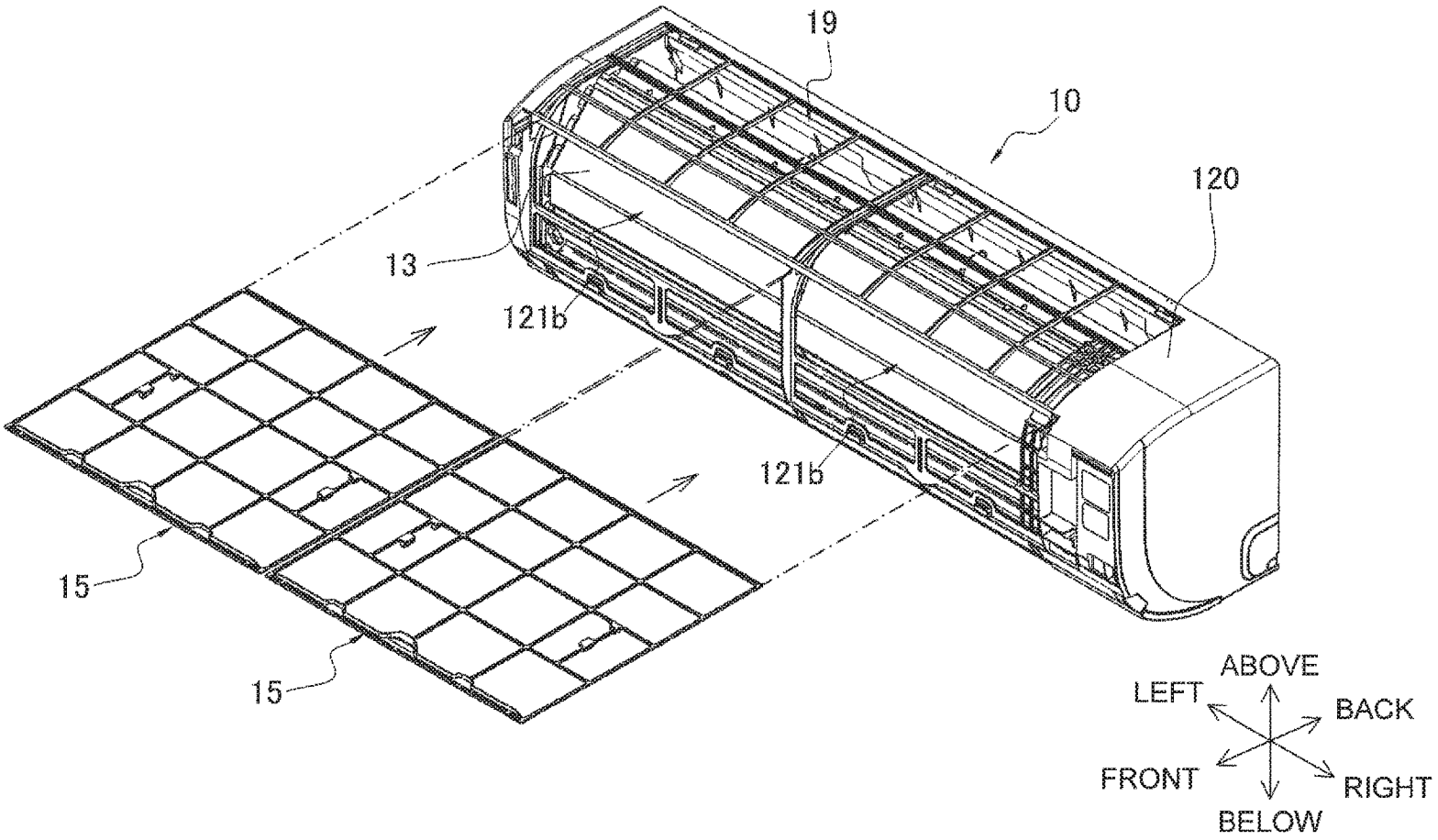
FIG. 3 illustrates a body separated from a filter.
Figure 4:
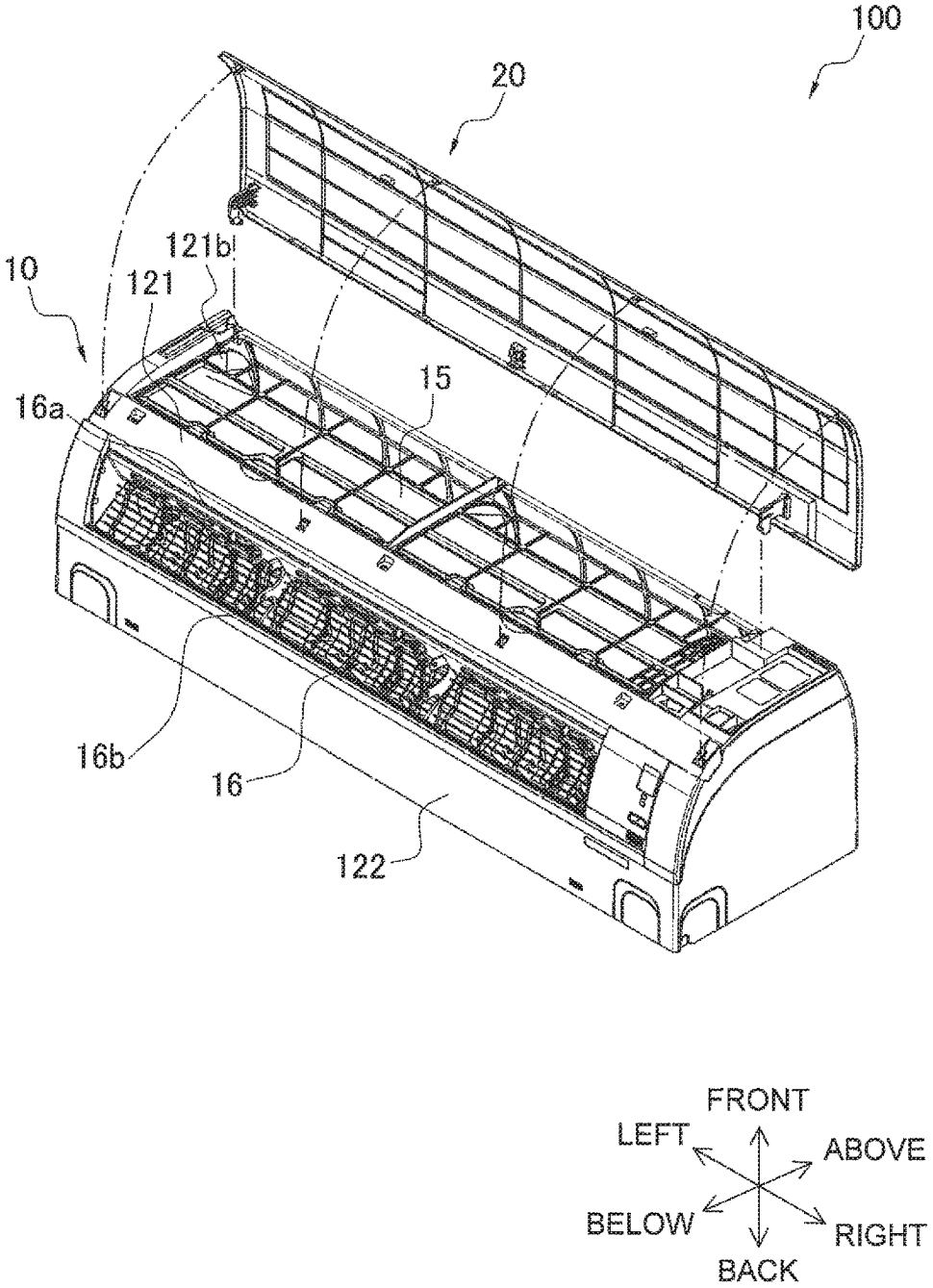
FIG. 4 illustrates the body separated from a front panel.

FIG. 1 is a vertical cross sectional view of the air conditioning indoor unit 100 according to one embodiment of the present invention. FIG. 2 is an explanatory view of a front grille 12 when mounted to an assembly of an indoor heat exchanger 13 and an indoor fan 14 in which the indoor heat exchanger 13 and the indoor fan 14 are fixed to a bottom frame 11. FIG. 3 is an explanatory view of filters 15 when mounted to a body 10. FIG. 4 is an explanatory view of a front panel 20 when mounted to the body 10 (the front grille 12). The dashed line arrows in FIG. 1 indicate an airflow sucked from air inlets 19 and reaching the indoor fan 14 and an airflow reaching an air outlet 16 from the indoor fan 14.

This air conditioning indoor unit 100 has an elongate shape as a whole in one direction (see FIG. 4 and the like), and is installed on a wall of a room to orient the longitudinal direction thereof in a horizontal position. The air conditioning indoor unit 100 performs various operations such as a cooling operation and a heating operation. The air conditioning indoor unit 100 is equipped with horizontal flaps 17*a*, 17*b* as air direction adjustment plates, and receives control signals from a remote controller or the like (not shown) or automatically varies orientations thereof to vary the air direction of conditioned air blown out from the air outlet 16.

(2) Detailed Structure of Air Conditioning Indoor Unit 100

(2-1) Body 10

The body 10 has the front grille 12 and the bottom frame 11. The indoor heat exchanger 13, the indoor fan 14 and the like are housed inside the body 10.

(2-1-1) Front Grille 12

The front grille 12 is composed of a resin, for example, is mounted to the bottom frame 11 from the front, and constitutes the front surface, both of the left and right side surfaces, the top surface, and the bottom surface of the body 10. The front grille 12 has an entirely open back surface, and has a thin and substantially rectangular shape. An installation plate 90 for installing the air conditioning indoor unit 100 on a wall of a room is fixed on the back side of the air conditioning indoor unit 100.

The air inlets 19 are formed in a top surface 120 of the front grille 12 except one end of both of longitudinal ends thereof. As shown in FIG. 3, the air inlets 19 are formed in the substantially entire of the top surface 120 except the right end thereof. The air inlets 19 are openings for sucking indoor air into the body 10.

Inlet openings 121*b* are formed in a front surface 121 of the front grille 12 at positions facing the front surface side of the indoor heat exchanger 13. The filters 15 are positioned between the inlet openings 121*b* and the indoor heat exchanger 13. The filters 15 extend from the front side to the upper side of the indoor heat exchanger 13 to collect dirt and dust in the indoor air taken in from the air inlets 19. Furthermore, an opening 121*c* defining the air outlet 16 is formed in the lower portion of the front surface 121 (see FIG. 2).

Figure 5:
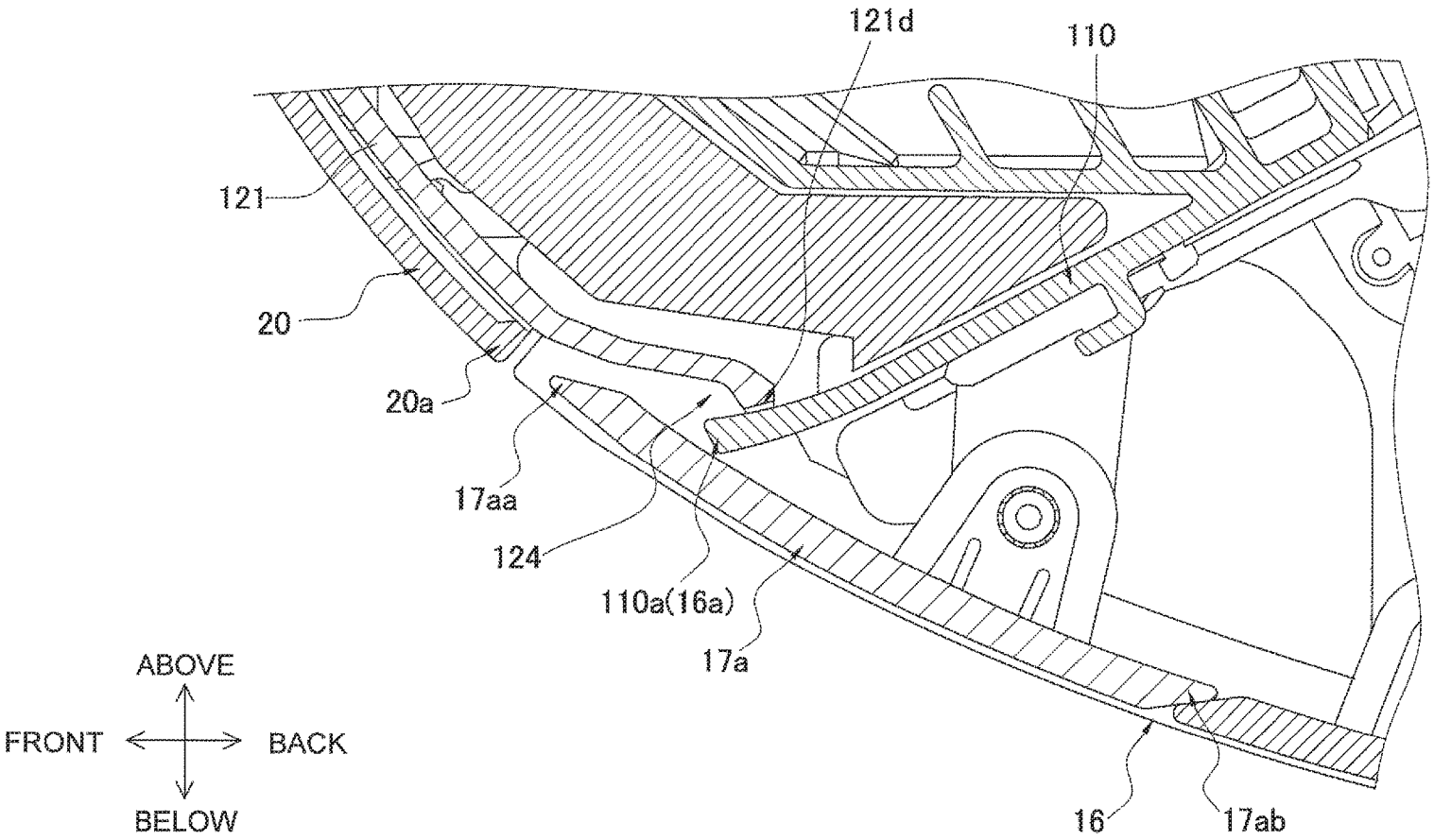
FIG. 5 is a partial cross sectional view of the vicinity of an air outlet.

FIG. 5 is a partial enlarged view of the vicinity of the air outlet 16. A recess 124 recessed toward the back side of the front grille 12, that is, the back side of the air conditioning indoor unit 100 is disposed in the front surface 121. The recess 124 is positioned above an upper edge 121*d* of an open peripheral edge of the opening 121*c* in the front surface 121. The recess 124 will be described in detail later.

As shown in FIG. 2, an opening 122*a* defining the air outlet 16 is formed in a bottom surface 122 of the front grille 12. The opening 122*a* is disposed in the front portion of the bottom surface 122, and defines the air outlet 16 along with the opening 121*c* formed in the lower portion of the front surface 121 and the bottom frame 11.

(2-1-2) Bottom Frame 11

The bottom frame 11 is composed of a resin, for example, and has a shape covering the lower part, the rear, and the sides of the indoor fan 14. The bottom frame 11 fixes the indoor heat exchanger 13 and the indoor fan 14.

The bottom frame 11, in the lower part thereof, defines the air outlet 16 along with the front grille 12. Specifically, as shown in FIG. 1, the lower ends (the front ends) of scrolls 110, 111 of the bottom frame 11 and the front grille 12 define the air outlet 16.

The scrolls 110, 111 for guiding the conditioned air to the air outlet 16 define a ventilation passage through which the air directed from the indoor fan 14 to the air outlet 16 flows. As shown in FIG. 1, the scrolls 110, 111 are partition walls curved and facing each other in front of and behind the indoor fan 14, and include a front scroll 110 and a rear scroll 111. The front scroll 110 extends from the front of the indoor fan 14 to the air outlet 16. The rear scroll 111 extends from the rear of the indoor fan 14 to the air outlet 16. The air passing through the ventilation passage travels along the scrolls 110, 111, and is sent in a tangential direction of the ends of the scrolls 110, 111 (see FIG. 7). Therefore, without the horizontal flaps 17*a*, 17*b* at the air outlet 16, the air direction of the conditioned air blown out from the air outlet 16 will be oriented generally in a direction along the tangent of the ends of the scrolls 110, 111.

(2-2) Horizontal Flaps 17*a*, 17*b*

The horizontal flaps 17*a*, 17*b* are plane or arc-shaped plate members. The horizontal flaps 17*a*, 7I have an area enough to close the air outlet 16. As shown in FIG. 1, the outer surfaces of the arc-shaped horizontal flaps 17*a*, 17*b* are finished to gentle, circular arcuate curved surfaces outwardly projecting in such a way as to lie on an extension of the curved surface of the front panel 20 in a state in which they close the air outlet 16. The inner surfaces of the horizontal flaps 17*a*, 17*b* have circular arcuate curved surfaces almost parallel to the outer surfaces.

The horizontal flaps 17*a*, 17*b* are configured to pivot around pivotal axes 18*a*, 18*b* when a motor (not shown) fixed to the body 10 is driven. The horizontal flaps 17*a*. 17*b* pivot around the pivotal axes 18*a*. 18*b* to assume various orientations.

In a state in which the horizontal flaps 17*a*, 17*b* opens the air outlet 16, the conditioned air blown out from the air outlet 16 flows generally along the inner surfaces of the horizontal flaps 17*a*, 17*b*. In other words, the air direction of the conditioned air blown out in the tangential direction of the ends of the scrolls 110, 111 is varied by the horizontal flaps 17*a*, 17*b*.

(2-3) Indoor Heat Exchanger 13 and Indoor Fan 14

The indoor heat exchanger 13 and the indoor fan 14 are mounted to the bottom frame 11. With regard to the indoor heat exchanger 13 and the indoor fan 14, in a cross section perpendicular to the longitudinal direction of the air conditioning indoor unit 100, the indoor fan 14 is positioned in the substantially middle of the air conditioning indoor unit 100, and the indoor heat exchanger 13 having an inverted V shape is positioned around the upper half of the indoor fan 14.

The indoor heat exchanger 13 performs heat exchange with the air passing therethrough. The indoor fan 14, which is, for example, a cross-flow fan, applies air having been taken in from the room through the air inlets 19 to the indoor heat exchanger 13 to allow the air to pass therethrough. Thereafter, the indoor fan 14 changes the air into an airflow directed to the air outlet 16 and blown out into the room through the air outlet 16.

(2-4) Front Panel 20

The front panel 20 is composed of a resin, for example, and is positioned in such a way as to cover the front of the body 10 (the front grille 12). It should be noted that, as indicated by the dashed line arrow A in FIG. 1, a space is formed between the front panel 20 and the front grille 12 (the front surface 121) to be a ventilation passage for the air sucked from the air inlets 19 and reaching the inlet openings 121*b*. The front panel 20 depicts a gentle, circular arcuate curved surface, and extends from the upper front portion of the body 10 toward the neighborhood of the air outlet 16.

The front panel 20 is configured to be detachable from the body 10 so that a user or an installation operator can readily detach the front panel 20 from the body 10. As a detachable configuration, the upper end of the front panel 20 may be pivotably supported on the front end of the top surface 120 of the front grille 12 to move in a hinged manner, for example.

(3) Detailed Structure in Neighborhood of Air Outlet 16

The air outlet 16 is disposed in the lower portion of the body 10, and is a rectangular opening whose longer sides lie in the longitudinal direction of the air conditioning indoor unit 100. As shown in FIG. 1, the air outlet 16 is disposed in the lower front portion of the body 10. An imaginary plane joining an upper edge 16*a* and a lower edge 16*b* of an open peripheral edge of the air outlet 16 is frontwardly and upwardly inclined. As discussed above, the air outlet 16 is defined by the front grille 12 and the bottom frame 11. In the present embodiment, as shown in FIG. 1, the lower edge 16*b* of the air outlet 16 is defined by a portion of the bottom surface 122 of the front grille 12. In addition, the upper edge 16*a* of the air outlet 16 is defined by a front end 110*a* of the front scroll 110. More specifically, as shown in FIG. 5, the front end 110*a* of the front scroll 110 is positioned below the upper edge 121*d* of the opening 121*c*, which is a portion of the lower end of the front surface 121 of the front grille 12. The front grille 12 is fixed to the bottom frame 11 such that the front end 110*a* of the front scroll 110 frontwardly projects relative to the upper edge 121*d*.

Figure 6:
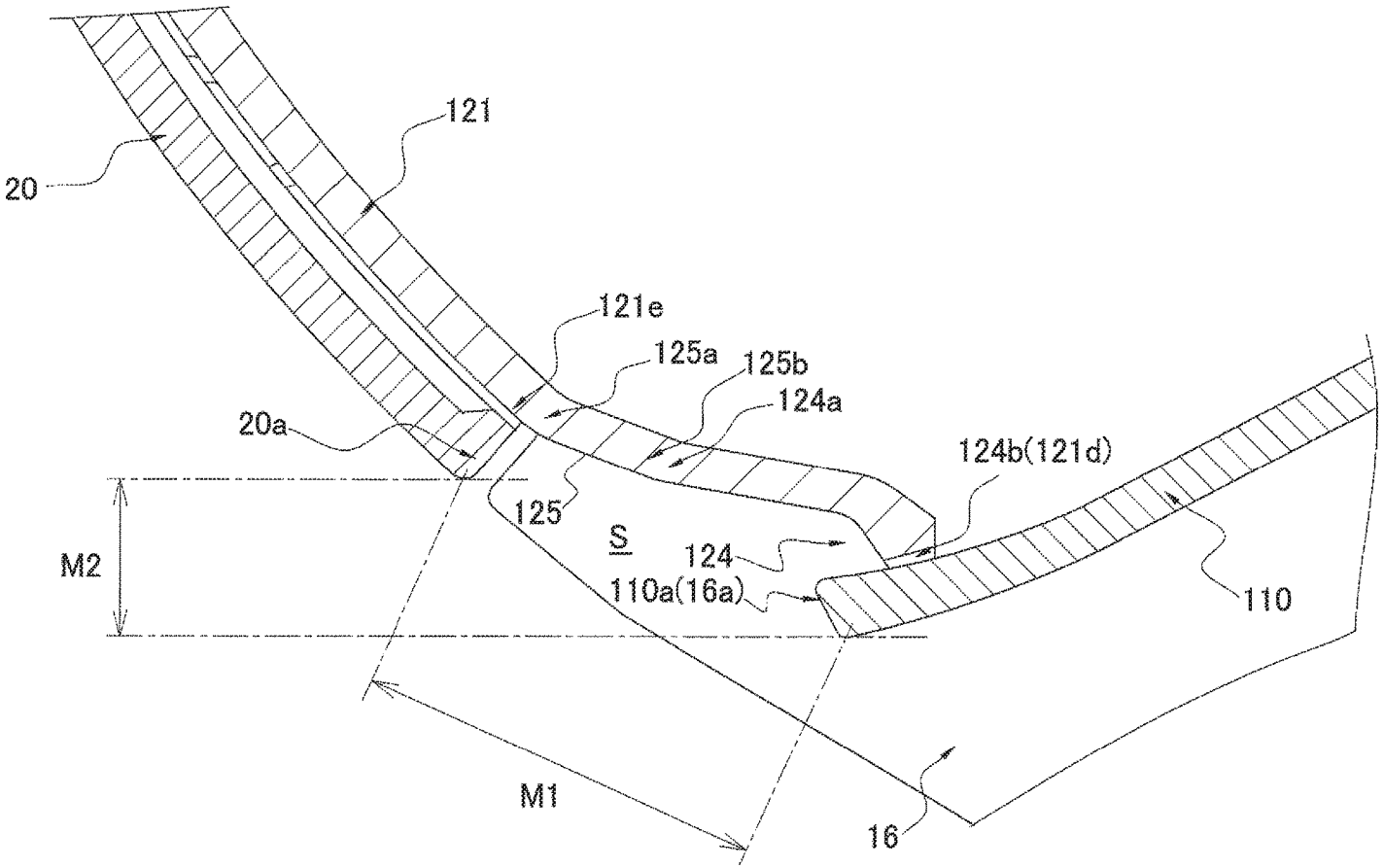
FIG. 6 is a partial cross sectional view of the vicinity of the upper edge of the air outlet.

FIG. 6 is a partial cross sectional view of the vicinity of the upper edge 16*a* of the air outlet 16. In the present embodiment, the upper edge 16*a* of the air outlet 16 and a lower end 20*a* of the front panel 20 are not in proximity to each other; as shown in FIG. 6, the upper edge 16*a* of the air outlet 16 and the lower end 20*a* of the front panel 20 are spaced from each other to form a space S between the upper edge 16*a* of the air outlet 16 and the lower end 20*a* of the front panel 20. It should be noted that the space S is designed to have a size M1 of 6 mm or more in the cross section perpendicular to the longitudinal direction of the air conditioning indoor unit 100, more preferably, the size M1 is 10 mm or more. Since the distance between the front end 110*a* of the front scroll 110 and the lower end 20*a* of the front panel 20 is designed to be 16 mm, the size M1 is 10 mm or more. The space S is also designed to have a vertical size M2 of 5 mm or more, more preferably the size M2 is 8 mm or more. Since the distance between a horizontal imaginary plane through the front end 110*a* of the front scroll 110 and a horizontal imaginary plane through the lower end 20*a* of the front panel 20 is designed to be 6 mm, the size M2 is 5 mm or more. During non-operation of the air conditioning indoor unit 100, the horizontal flaps 17*a*. 17*b* are positioned in such a way as to cover not only the air outlet 16 but also the space S. Specifically, as shown in FIGS. 1 and 5, during the non-operation, the horizontal flap 17*a* is positioned such that a front end 17*aa* of the horizontal flap 17*a* is adjacent to the lower end 20*a* of the front panel 20. Thus, during the non-operation, since not only the air outlet 16 but also the space S is covered by the horizontal flaps 17*a*, 17*b*, the space S is hardly visible from outside.

Furthermore, the recess 124 is disposed above the upper edge 121*d* of the opening 121*c* of the front surface 121 of the front grille 12, that is, above the upper edge 16*a* of the air outlet 16. As shown in FIGS. 5 and 6, the recess 124 is a portion of the front surface 121 recessed toward the back side of the air conditioning indoor unit 100 relative to the other portion. During the non-operation of the air conditioning indoor unit 100, the horizontal flaps 17*a*, 17*b* are positioned in such a way as to cover not only the air outlet 16 but also the recess 124. Specifically, as shown in FIGS. 1 and 5, during the non-operation, the horizontal flap 17*a* is positioned such that the front end 17*aa* of the horizontal flap 17*a* is adjacent to the lower end 20*a* of the front panel 20. Thus, during the non-operation, since not only the air outlet 16 but also the recess 124 is covered by the horizontal flaps 17*a*, 17*b*, the recess 124 is hardly visible from outside.

The front surface 121 includes an inclination surface 125 between an upper edge 124*a* of the perimeter of the recess 124 and the lower end 20*a* of the front panel 20. More specifically, as shown in FIG. 6, the inclination surface 125 extends from a portion 121*e* of the front surface 121 located to face the lower end 20*a* of the front panel 20 to the upper edge 124*a* of the perimeter of the recess 124. The inclination surface 125 has an end (hereinafter, referred to as a front end 125*a*) adjacent to the portion 121*e* located to face the lower end 20*a* of the front panel 20 and located in front of another end (hereinafter, referred to as a rear end 125*b*) adjacent to the upper edge 124*a* of the perimeter of the recess 124. Furthermore, the front end 125*a* is located above relative to the rear end 125*b* with respect to the horizontal direction in the inclination surface 125. Thus, the inclination surface 125 is inclined toward the back side of the air conditioning indoor unit 100. It should be noted that the recess 124 is designed to have a cross-sectional area perpendicular to the longitudinal direction of 10 $mm^2$ or more. As shown in FIG. 5 and the like, during the non-operation, the horizontal flaps 17*a*. 17*b* are positioned in such a way as to cover the air outlet 16, the recess 124, and the inclination surface 125. Furthermore, as shown in FIGS. 5 and 6, the front end 110*a* of the front scroll 110 is located in front of the upper edge 121*d* of the front surface 121 corresponding to a lower edge 124*b* of the perimeter of the recess 124. Thus, the front end 110*a* of the front scroll 110 frontwardly projects relative to a portion of the front surface 121 located in the neighborhood of the air outlet 16.

(4) Control of Air Direction of Conditioned Air

The air conditioning indoor unit 100 of the present embodiment allows the horizontal flaps 17*a*, 17*b* to pivot to assume predetermined orientations, thereby having at least an upward blowing mode for guiding the conditioned air upwardly and a horizontal blowing mode for guiding the conditioned air frontwardly (horizontally).

(4-1) Upward Blowing Mode

Figure 7:
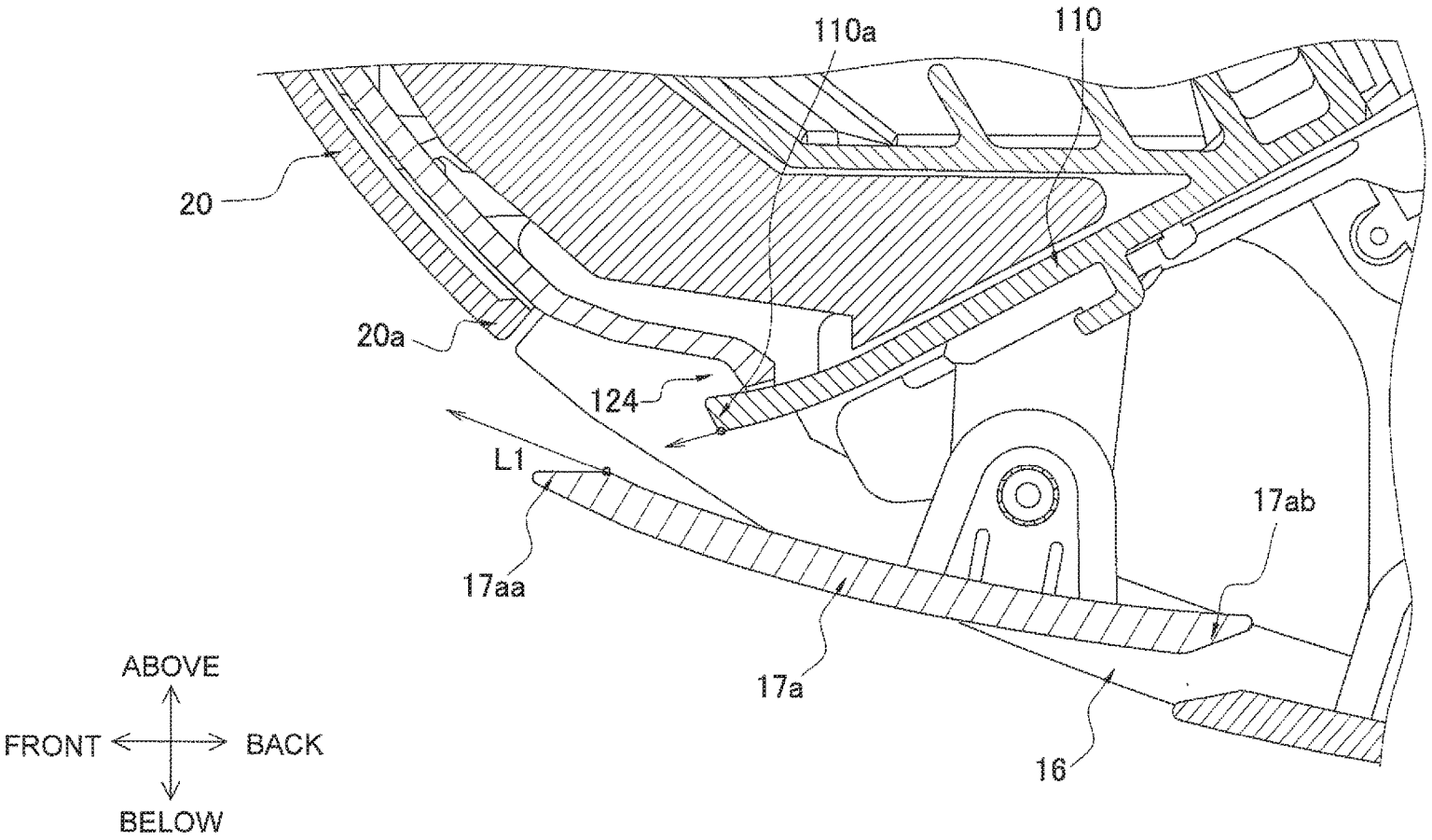
FIG. 7 is a partial cross sectional view of the vicinity of the air outlet during execution of an upward blowing mode.

FIG. 7 is a partial cross sectional view of the neighborhood of the air outlet 16 during execution of the upward blowing mode. In the upward blowing mode, the horizontal flaps 17*a*, 17*b* pivot until the front end 17*aa* of the horizontal flaps 17*a*, 17*b* is located above a rear end 17*ab* (see FIG. 7). In the case in which the inner surfaces of the horizontal flaps 17*a*, 17*b* have circular arcuate curved surfaces as the present embodiment, the horizontal flaps 17*a*, 17*b* pivot until a tangent L1 at the front end of the inner curved surface is frontwardly and upwardly oriented with respect to the front and rear direction (horizontal direction). Thereby, the conditioned air is upwardly blown out.

(4-2) Horizontal Blowing Mode

Figure 8:
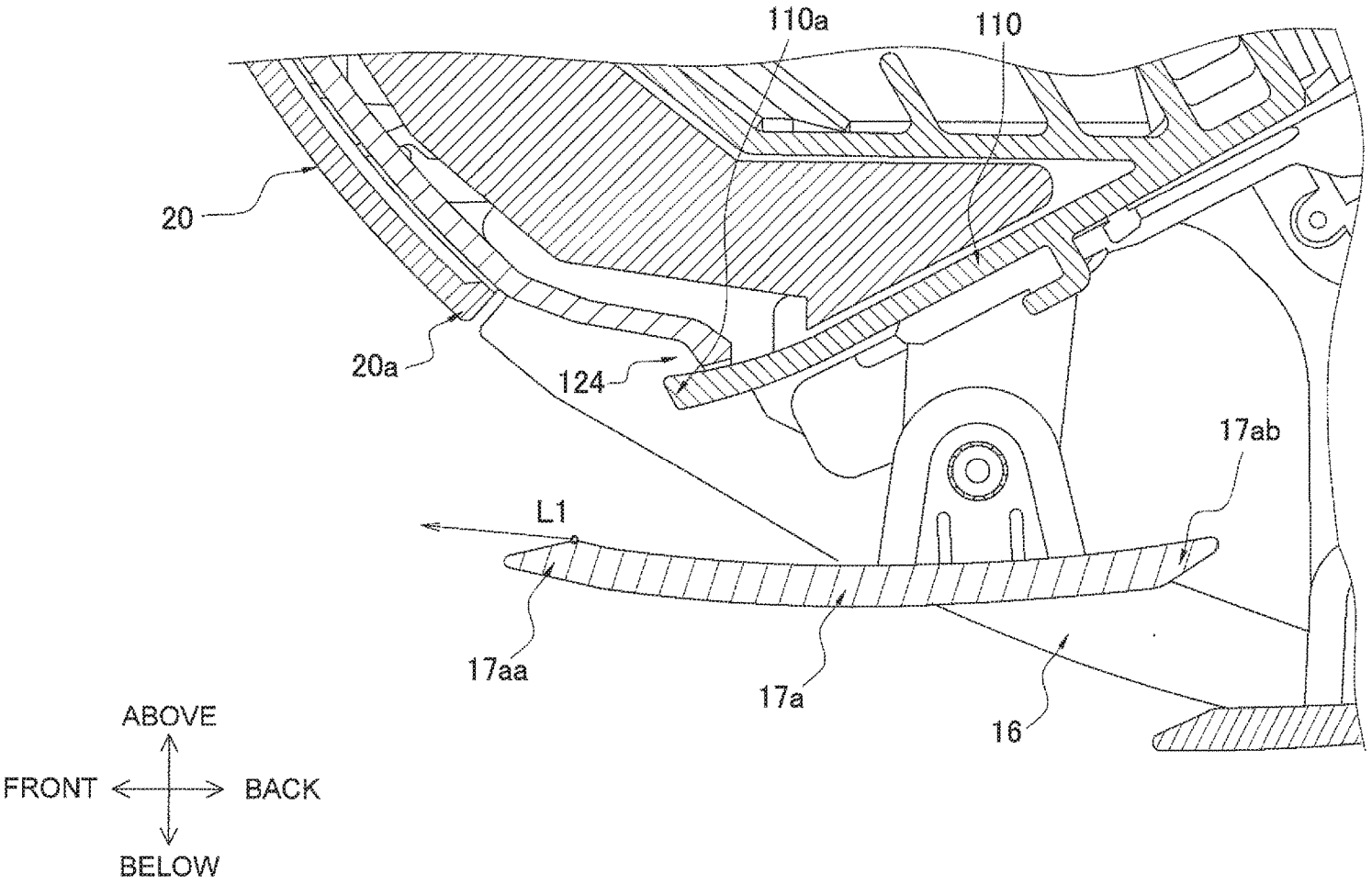
FIG. 8 is a partial cross sectional view of the vicinity of the air outlet during execution of a horizontal blowing mode.

FIG. 8 is a partial cross sectional view of the neighborhood of the air outlet 16 during execution of the horizontal blowing mode. In the horizontal blowing mode, the flaps pivot until the front end 17*aa* and the rear end 17*ab* of the horizontal flaps 17*a*. 17*b* are oriented in a horizontal position (see FIG. 8). In the present embodiment, the horizontal flaps 17*a*, 17*b* pivot until the tangent L1 at the front end of the inner curved surface of the horizontal flaps 17*a*, 17*b* is oriented in a substantially horizontal position. Thereby, the conditioned air is horizontally blown out.

(5) Features (5-1)

In such an air conditioning indoor unit comprising configurations of a front panel positioned in front of a body and an air outlet located below the front panel as the present embodiment, when horizontal flaps upwardly adjusts the air direction of conditioned air blown out from the air outlet, a short circuit may occur in which the conditioned air is sucked into the body from a joint between the body and the lower end of the front panel. If this conditioned air is cold air, due to a difference in temperature between the front surface and the back surface of the front panel, condensation may occur on the front surface of the lower end of the front panel.

In the present embodiment, the recess 124 is disposed between the upper edge 16*a* of the air outlet 16 and the lower end 20*a* of the front panel 20. Thus, when the upward blowing mode is executed during the cooling operation, even when the horizontal flaps 17*a*, 17*b* upwardly adjusts the air direction of cold air as conditioned air, the cold air can be reduced from entering from a joint between the lower end 20*a* of the front panel 20 and the body 10 (the front surface 121 of the front grille 12). Thereby, the likelihood of occurrence of condensation on the front surface of the lower end 20*a* of the front panel 20 can be reduced.

Since the likelihood of occurrence of condensation on the front of the lower end 20*a* of the front panel 20 can be reduced according to the present embodiment, the upward blowing mode can be executed without an increase in a temperature of conditioned air (air blown out).

Furthermore, in the present embodiment, since during the non-operation not only the air outlet 16 but also the recess 124 between the upper edge 16*a* of the air outlet 16 and the lower end 20*a* of the front panel 20 is covered by the horizontal flaps 17*a*, 17*b*, the recess 124 is hardly visible from outside during the non-operation. Therefore, the design thereof can be reduced from degrading compared to the design of a configuration of the recess 124 visible from outside during the non-operation.

In addition, in the present embodiment, since the likelihood of occurrence of condensation on the front of the lower end 20*a* of the front panel 20 can be reduced, anti-dew materials such as thermal insulations are not needed, so that appearance thereof becomes better Thereby, the occurrence of condensation on the front surface of the air conditioning indoor unit 100 can be reduced, and the design thereof can be reduced from degrading.

(5-2)

In the present embodiment, the space S is disposed between the upper edge 16*a* of the air outlet 16 and the lower end 20*a* of the front panel 20, and has the size M1 of 6 mm or more and the vertical size M2 of 5 mm or more in the cross-section perpendicular to the longitudinal direction. Thus, when the horizontal blowing mode is executed during the cooling operation, even when the horizontal flaps 17*a*. 17*b* horizontally adjusts the air direction of cold air as conditioned air, the cold air can be reduced from entering from the joint between the lower end 20*a* of the front panel 20 and the body 10 (the front surface 121 of the front grille 12). Thereby, the likelihood of occurrence of condensation on the front of the lower end 20*a* of the front panel 20 can be reduced.

(5-3)

In the present embodiment, the recess 124 is disposed in a portion of the front surface 121 of the front grille 12 located above the upper edge 16*a* of the air outlet 16.

Thus, when the upward blowing mode is executed during the cooling operation, even when the horizontal flaps 17*a*, 17*b* upwardly adjusts the air direction of cold air as conditioned air, the airflow blown out from the air outlet 16 along the upper edge 16*a* of the air outlet 16 can be separated from the front surface 121.

Thereby, cold air can be reduced from entering between the lower end 20*a* of the front panel 20 and the body 10 (the front grille 12).

(5-4)

The recess 124 of the present embodiment is designed to have the cross-sectional area perpendicular to the longitudinal direction of 10 $mm^2$ or more. Thus, the likelihood of an airflow along the upper edge 16*a* of the air outlet 16 not being separated from the front surface 121 and reaching the portion 121*e* located in the neighborhood of the lower end 20*a* of the front panel 20 can be reduced.

(5-5)

In the front surface 121 of the front grille 12 of the present embodiment, the inclination surface 125 lies between the upper edge 124*a* of the perimeter of the recess 124 and the lower end 20*a* of the front panel 20. The inclination surface 125 is inclined toward the back side of the air conditioning indoor unit 100. Thus, during air conditioning operations by the air conditioning indoor unit 100, that is, even when the horizontal flaps 17*a*, 17*b* do not cover the space S between the upper edge 16*a* of the air outlet 16 and the lower end of the front panel 20, the likelihood of the recess 124 being conspicuous can be reduced.

(5-6)

A portion of conditioned air having flown along a front scroll and reached an air outlet may be an airflow along an upper edge of the air outlet. Thereafter, in the case in which the upper edge of the air outlet is defined by the front surface of a front grille, the portion of the conditioned air having flown along the front scroll and reached the air outlet may upwardly flow along the front surface.

In the present embodiment, the front end 110*a* of the front scroll 110 frontwardly projects relative to the portion of the front surface 121 located in the neighborhood of the air outlet 16. The front end 110*a* of the front scroll 110 defines the upper edge 16*a* of the air outlet 16. Thereby, since the conditioned air having flown along the front scroll 110 and reached the air outlet 16 is blown out along the tangent of the end of the front scroll 110, the likelihood of the conditioned air, which has been blown out from the air outlet 16, flowing along the front surface 121 of the front grille 12 can be reduced.

(6) Modification (6-1) Modification A

In the above embodiment, cold air can be reduced from entering from the joint between the lower end 20*a* of the front panel 20 and the front surface 121 of the front grille 12, thereby preventing the occurrence of condensation on the front of the lower end 20*a* of the front panel 20. For this prevention of the occurrence of condensation, the space S is disposed between the upper edge 16*a* of the air outlet 16 and the lower end 20*a* of the front panel 20; the recess 124 is disposed in the front surface 121; the front end 110*a* of the front scroll 110 frontwardly projects relative to the upper edge 121*d* of the opening 121*c*, which is a portion of the lower end of the front surface 121.

However, as long as the space S is disposed between the upper edge 16*a* of the air outlet 16 and the lower end of the front panel 20, the present invention is not limited thereto; the present invention may not comprise configurations of the recess 124 and the front end 110*a* of the front scroll 110, for example. Alternatively, the present invention may comprise a configuration of either the recess 124 or the front end 110*a* of the front scroll 110 in addition to a configuration of the space S disposed between the upper edge 16*a* of the air outlet 16 and the lower end 20*a* of the front panel 20.

(6-2) Modification B

In the above embodiment, the inclination surface 125 is arranged between the upper edge 124*a* of the perimeter of the recess 124 and the lower end 20*a* of the front panel 20. However, the present invention is not limited thereto; the inclination surface 125 may not be arranged. It should be noted that in terms of the design improvement, preferably, the inclination surface 125 is arranged.

INDUSTRIAL APPLICABILITY

According to the present invention, the occurrence of condensation on the front surface of the air conditioning indoor unit can be reduced, and the design thereof can be improved.

What is claimed is:

1. An air conditioning indoor unit, comprising:

a body including an air outlet, the air outlet having an upper edge defined by an upper edge member;

a panel positioned to cover a front of the body; and a horizontal flap able to vary an air direction of conditioned air blown out from the air outlet, a recess recessed toward a back side of the body, the recess being disposed between the upper edge of the air outlet and a lower end of the panel, the upper edge member frontwardly projecting toward the lower end of the panel so that the recess is partially defined by an upwardly facing surface of the upper edge member, and during non-operation, the recess and the air outlet being covered by the horizontal flap.

2. The air conditioning indoor unit according to claim 1, wherein the recess is located above the upper edge of the air outlet in the body.

3. The air conditioning indoor unit according to claim 1, wherein a cross-sectional area of the recess is at least 10 $mm^2$ and is perpendicular to a longitudinal direction of the air conditioning indoor unit.

4. The air conditioning indoor unit according to claim 1, wherein the body further includes an inclination surface between an upper edge of a perimeter of the recess and the lower end of the panel, the inclination surface is inclined toward the back side of the body, and during non-operation, the recess, the air outlet, and the inclination surface are covered by the horizontal flap.

5. The air conditioning indoor unit according to claim 1, further comprising a fan positioned in the body and generating a flow of air having been sucked into the body toward the air outlet, the body further including a grille including a front surface, the panel being positioned in front of the front surface, and the upper edge member, the upper edge member being a scroll extending from a front of the fan to the air outlet to guide conditioned air to the air outlet, a front end of the scroll projects more frontwardly relative to a portion of the front surface located in the neighborhood of the air outlet.

6. The air conditioning indoor unit according to claim 2, wherein a cross-sectional area of the recess is at least 10 $mm^2$ and is perpendicular to a longitudinal direction of the air conditioning indoor unit.

7. The air conditioning indoor unit according to claim 2, wherein the body further includes an inclination surface between an upper edge of a perimeter of the recess and the lower end of the panel, the inclination surface is inclined toward the back side of the body, and during non-operation, the recess, the air outlet, and the inclination surface are covered by the horizontal flap.

8. The air conditioning indoor unit according to claim 2, further comprising a fan positioned in the body and generating a flow of air having been sucked into the body toward the air outlet, the body further including a grille including a front surface, the panel being positioned in front of the front surface, and the upper edge member, the upper edge member being a scroll extending from a front of the fan to the air outlet to guide conditioned air to the air outlet, a front end of the scroll projects more frontwardly relative to a portion of the front surface located in the neighborhood of the air outlet.

9. The air conditioning indoor unit according to claim 3, wherein the body further includes an inclination surface between an upper edge of a perimeter of the recess and the lower end of the panel, the inclination surface is inclined toward the back side of the body, and during non-operation, the recess, the air outlet, and the inclination surface are covered by the horizontal flap.

10. The air conditioning indoor unit according to claim 3, further comprising a fan positioned in the body and generating a flow of air having been sucked into the body toward the air outlet, the body further including a grille including a front surface, the panel being positioned in front of the front surface, and the upper edge member, the upper edge member being a scroll extending from a front of the fan to the air outlet to guide conditioned air to the air outlet, a front end of the scroll projects more frontwardly relative to a portion of the front surface located in the neighborhood of the air outlet.

11. The air conditioning indoor unit according to claim 4, further comprising a fan positioned in the body and generating a flow of air having been sucked into the body toward the air outlet, the body further including a grille including a front surface, the panel being positioned in front of the front surface, and the upper edge member, the upper edge member being a scroll extending from a front of the fan to the air outlet to guide conditioned air to the air outlet, a front end of the scroll projects more frontwardly relative to a portion of the front surface located in the neighborhood of the air outlet.

* * * * *